United States Patent [19]

Gerwick et al.

[11] Patent Number: 4,579,481

[45] Date of Patent: Apr. 1, 1986

[54] MOBILE OFFSHORE DRILLING STRUCTURE FOR THE ARCTIC

[75] Inventors: Ben C. Gerwick, San Francisco, Calif.; Robert F. Mast, Auburn, Wash.

[73] Assignee: Standard Oil Company, Ohio

[21] Appl. No.: 489,757

[22] Filed: Apr. 29, 1983

[51] Int. Cl.[4] ..... E02B 17/00

[52] U.S. Cl. ..... 405/227; 405/203; 405/205

[58] Field of Search ..... 405/217, 203, 204, 205, 405/207, 208, 224, 227; 114/40, 41, 42

[56] References Cited

U.S. PATENT DOCUMENTS

| | | | |
|---|---|---|---|
| 2,472,869 | 6/1949 | Travers | 405/205 X |
| 2,960,832 | 11/1960 | Hayward | 405/227 |
| 3,054,268 | 9/1962 | Muller | 405/207 |
| 3,081,600 | 3/1963 | Davidon | 405/208 |
| 3,145,538 | 8/1964 | Young | 405/224 X |
| 3,277,653 | 11/1963 | Foster | 405/196 |
| 3,793,840 | 2/1974 | Mott et al. | 405/217 |
| 3,925,997 | 12/1975 | Hafskjold | 405/224 X |
| 3,999,395 | 12/1976 | Broms et al. | 405/227 |
| 4,245,929 | 1/1981 | Pearce et al. | 405/211 |
| 4,314,776 | 2/1982 | Palmer et al. | 405/205 |
| 4,422,804 | 12/1983 | Gerwick et al. | 405/210 |
| 4,425,055 | 1/1984 | Tiedemann | 405/204 X |
| 4,427,320 | 1/1984 | Bhula | 405/211 |

FOREIGN PATENT DOCUMENTS

| | | | |
|---|---|---|---|
| 976773 | 10/1975 | Canada | 405/217 |
| 0119019 | 9/1981 | Japan | 405/227 |

*Primary Examiner*—Dennis L. Taylor

*Attorney, Agent, or Firm*—David J. Untener; L. W. Evans

[57] ABSTRACT

A mobile platform structure, installation and method for use in arctic waters where the dominant environmental loading threats are posed by winter ice pressures and summer ice floes. The structure includes an ice load bearing, submergible substructure and a platform superstructure of approximately equal lateral dimensions. The substructure has a height approximately equal its depth of submergence when ballasted down onto the sea floor and includes a plurality of peripherally arranged, surface accessible spud guides. The spuds are laterally restrained by the spud guides in the top and bottom walls for transmission of lateral loads therebetween at respective vertically spaced apart fulcrum points and are vertically movable in the spud guides for penetration into high shear soils which may be overlaid by relatively low shear soils whereby the shear capacities of both soils combine with the frictional capacity of the structure/sea floor interface to provide high displacement resistance to lateral ice loads. Provision also is made for extracting the spuds for redeployment of the structure at another arctic installation site and for fixedly but releasably securing the spuds in an elevated position within the spud guides when not in use.

46 Claims, 14 Drawing Figures

MOBILE OFFSHORE DRILLING STRUCTURE FOR THE ARCTIC

DISCLOSURE

This invention relates generally to a mobile platform structure, installation and method for use in arctic waters where the dominant environmental loading threats are posed by winter ice pressures and summer ice floe impacts, and which have particular application to exploratory drilling for oil and gas in the substratum underlying offshore waters and ice formations.

BACKGROUND

In shallow arctic waters off the northern coasts of Alaska and Canada, man-made islands have been built to provide support for oil and gas exploration and production facilities. The islands typically have been made from fill material such as gravel placed on the sea floor at the offshore site. Such islands, however, only have practical application in shallow waters because the amounts of fill material required and associated construction costs increase greatly with small increases in water depth. Moreover, satisfactory fill material is a relatively scarce commodity in many arctic regions requiring transportation of the same over great distances. Construction of such islands is even further hindered by the relatively short construction season when the installation site is free or relatively free of ice. Of course, there also are environmental considerations in view of the relative permanence of the islands in relation to mobile platform structures that have been used in non-arctic regions for exploratory drilling.

Mobile platform structures heretofore used in non-arctic regions generally fall into two categories consisting of those intended for deep water installation and others intended for relatively shallow water installation. For example, one proposed platform structure intended for deep water installation, as at depths on the order of 150 and 300 feet, is disclosed in U.S. Pat. No. 3,277,653. Such structure includes an elevated platform supported by a tripod arrangement of three vertical legs that may be separately driven into the sea floor foundation as through a layer of alluvial soil or soft mud and into the underlying sands to obtain desired load bearing capacity. The shallow water platforms are typified by barge-like structures and some are known to employ spud piles for anchoring purposes while others have employed fixed skirts. Notwithstanding any differences between these two categories of structures, both commonly have provision for floating the structure for deployment and redeployment at installation sites.

These non-arctic structures, however, are not designed to withstand the large ice loads encountered in arctic offshore regions. In addition to large compressive or crushing ice loads, a structure can be subjected to gigantic lateral forces due to ice movement during the winter and ice floe impacts during the summer. Loading severities increase dramatically in moving from shallow waters in which shore-fast ice dominates to the deeper waters of the transition zone that interfaces with the Polar Pack. In the transition zone or relatively open water areas, ice sheet formations move considerably and thus impose very high lateral displacement forces on any structure in their paths. Obviously, any such structure used for exploratory drilling purposes must remain laterally fixed against such forces to maintain vertical alignment of the structure with the well or wells being drilled. Those structures employing skirts also are unacceptable because of draft requirements imposed by the arctic waters off the northern coast of Alaska, specifically Point Barrow, and because of the inability of the typical shallow water arctic platform to force the skirts into stronger soils.

A few mobile arctic platform structures have been proposed. One proposed structure is disclosed in U.S. Pat. No. 3,793,840 and includes a vertically narrow, barge-like base which may be ballasted onto the sea floor. Supported on the base is a conical shell provided with an upwardly extending column which receives a vertically positionable deck. The base is anchored against lateral forces primarily by a caisson which is longitudinally movable inside the base for embedment in the sea floor foundation and secondarily or optionally by a plurality of relatively short spud piles driven through openings in the base and into the sea floor foundation. When redeployment of the structure is desired, the structure is separated from the caisson and presumably the spud piles by deballasting the base, the structure then rising clear of the caisson and piles for refloating to another installation site.

Another proposed structure is disclosed in U.S. Pat. No. 4,245,929 and includes a multi-angle conical base which supports a work platform. The base is provided with ballast chambers for partial submergence onto and into the sea floor foundation. For resistance against lateral ice loads, the structure relies significantly on the ice breaking ability of its conical base. For unusually severe ice conditions, piles may be driven through guides in the base and into the sea floor foundation to assist in holding the structure in place, such piles being detached from the structure prior to its being floated to a new drilling site.

A common feature of both of these mobile arctic structures is their provision of a broad base support which is considerably larger or at least about twice as large as the supported working deck in horizontal dimension. Accordingly, these types of structures, when outfitted with a typical working desk, would be quite massive and have extremely wide bases, and additionally would result in increased seismic forces and probably increased ice forces. In addition, the pilings or spud piles associated with either structure are not surface accessible for ease in driving the same into the sea floor foundation from the structure itself. Presumably, another vessel is required for purposes of driving the piles located laterally remote of any above water support or deck on the structure. Also, the spud piles are treated as an expendable but costly commodity inasmuch as they are left behind upon relocation of the structure. It further is noted that the structure disclosed in U.S. Pat. No. 3,793,840 has the further drawback that any lateral shifting of the structure due to extreme loads necessarily will cause the caisson to shift thus presenting the possibility of damage to the therein located well heads and associated equipment.

SUMMARY OF THE INVENTION

The present invention encompasses a unique approach to the provision and installation of a mobile platform structure which is capable of withstanding the large compression and lateral ice loads encountered in arctic offshore regions. In particular, the structure, installation and method of the invention are characterized by a plurality of spuds and their manner of use and integration into the structure. Moreover, the structure is essentially self-contained and relatively compact, and has provision for driving and extracting surface accessible spuds for the structure itself.

Briefly, the mobile platform structure taught herein comprises an ice load bearing, submergible substructure and a platform superstructure of approximately equal lateral dimensions, the latter being supported on the substructure and above sea level when the substructure is ballasted onto the sea floor. The substructure has a height approximately equal the desired depth of submergence and includes horizontal top and bottom walls, a substantially vertical, peripheral side wall surrounding the top and bottom walls, and a plurality of vertical bulkheads extending between the top and bottom walls to form a plurality of ballast compartments. Also provided is a plurality of vertical spud guides including spud sleeves interposed between the vertical bulkheads and connected top and bottom to the top and bottom walls, and a plurality of relatively long spuds extending vertically through the spud sleeves. The spuds operably are laterally restrained by the spud guides in the top and bottom walls for transmission of lateral loads therebetween at respective vertically spaced apart fulcrum points and are vertically movable in the spud guides for penetration into the sea floor substrate or foundation.

More particularly, the spuds consist of large diameter steel cylinders which are reactively supported by bushings at the top and base of the substructure for lateral load transfer to the horizontal top and bottom walls of the substructure. Under overload, the spuds are capable of failure, first in sliding and then in bending, prior to damage to the structure. In addition, the spuds are free to move vertically in the structure so that the structure can maintain contact with the soil during any consolidation settlements and tilt slightly as necessary to develop bearing resistance to overturning moments without overloading the structure locally at spud support points. Under impact loads such as those from multiyear ice floe, the compliance of the spuds in bending and the soils in strain achieve a significant reduction in maximum applied force. In essence, the spuds act primarily as cantilever bending restraints having considerable flexibility and ductility to displace under high impact loads and thus serve to absorb energy and make a relatively uniform and balanced distribution of shear loads from structure to soil, this being particularly important with respect to eccentric loads which tend to rotate the structure.

According to another important aspect of the invention, the spuds are readily accessible above sea level for facilitating selective driving thereof into the sea floor foundation from the structure. A spud driver is moved from spud to spud by a suitable transfer such as a crane mounted on the platform superstructure for driving a selected number of spuds at selected locations to selected depths. Provision also is made for extraction of the spuds for redeployment of the structure at another installation site, there being provided above each spud a suitable support for vertical transfer of reactionary spud extraction forces by the substructure to the sea floor. When extracted or prior to deployment, the spuds are fixedly but releasably secured in an elevated position within the spud guides.

According to still another important aspect of the invention, the installation of the structure is effected by first floating it to a selected arctic installation site and then introducing ballast such as water into the ballast compartments to bring the structure to rest onto the sea floor for transfer of vertical loads and also lateral loads through friction between the bottom of the substructure and sea floor. The foundation soils immediately underlying the sea floor are then analyzed for determination of the number, locations and penetrations of the spuds required to provide adequate lateral resistance against anticipated lateral loads upon being driven into a layer of strong or high shear soils which may be overlaid or interbedded by one or more layers of weak or low shear soils. Accordingly, only a minimum selected number of spuds need be driven into the sea floor foundation to desired depths to reduce installation time as well as extraction time upon redeployment of the structure. As will be appreciated, the shear capacities of both the weak and strong soil layers combine with the frictional capacity of the structure/sea floor interface to provide high displacement resistance to lateral ice loads. Moreover, the bearing of the structure on the sea floor confines the soil beneath and hence greatly improves the shear capacity of the spuds. By using spuds in the foregoing manner, considerable freedom is given as to how much weight must be imposed on the soil. Ballasting can be adjusted or tuned so as to give the optimal bearing suitable to the soil encountered at the installation site, i.e., to optimize the bearing values and shear mechanisms for specific sites. Also, high displacement resistance is obtained independently of any well protecting caisson received within the structure and/or extremely massive and wide conical base structure associated with previously proposed arctic mobile structures.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
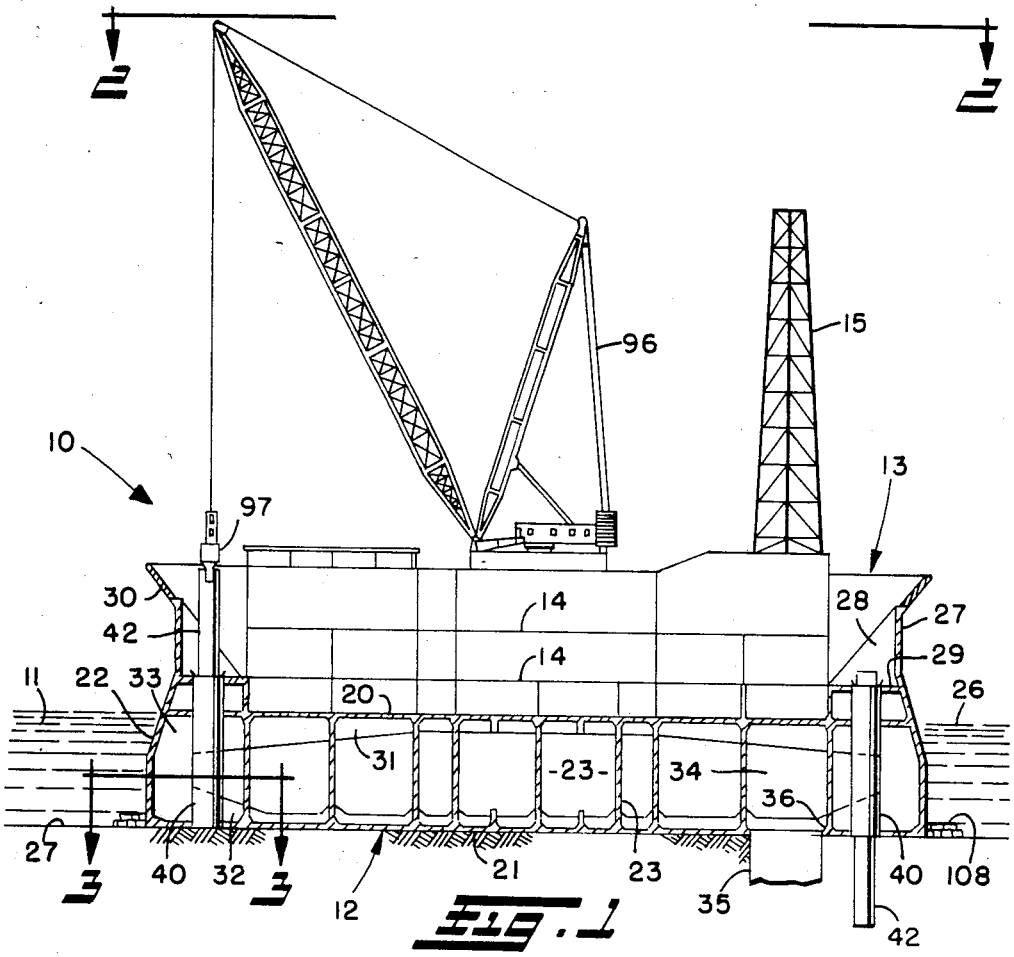
FIG. 1 is a vertical sectional view through a mobile drilling structure according to the present invention at an arctic offshore installation site.
Figure 2:
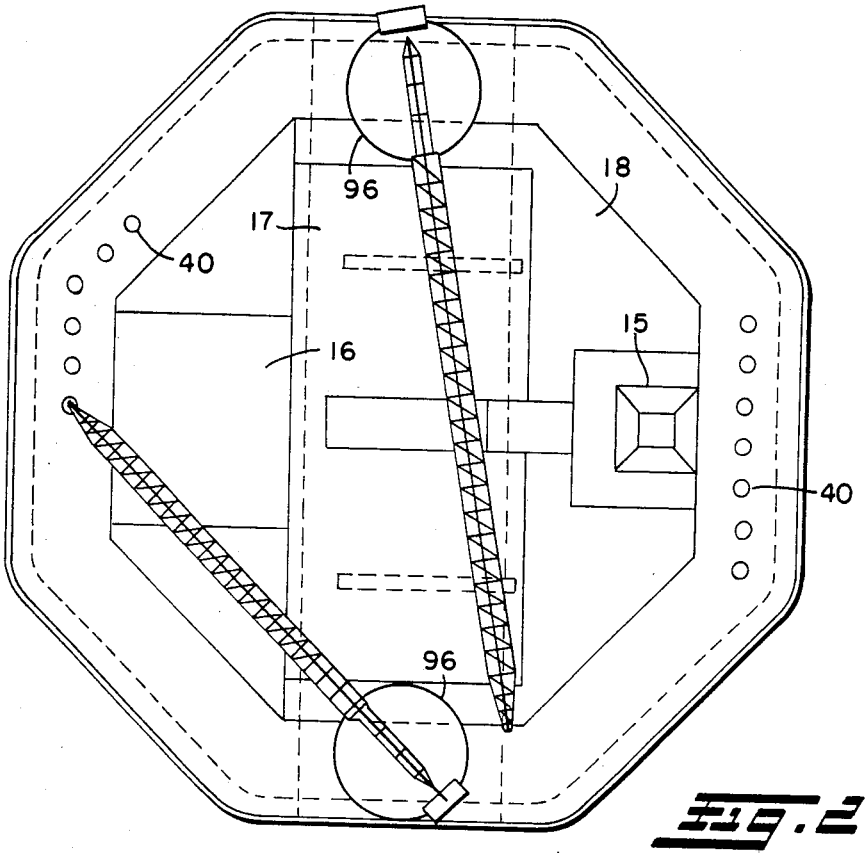
FIG. 2 is a top plan view of the structure of FIG. 1 as seen from the line 2—2 thereof.

Referring now in detail to the drawings and initially to FIGS. 1 and 2, reference numeral 10 identifies a mobile drilling structure installed in arctic offshore waters 11 according to the invention. The structure 10 includes, as a major component, a prestressed and reinforced concrete substructure or base 12 and a concrete and steel superstructure 13 supported on the substructure. The superstructure 13 consists of one or more platforms or decks 14 and supports thereon a self-contained drilling rig 15 and associated equipment and supplies in various storage compartments and areas such as living quarters 16 and equipment areas 17 and 18. Although outfitted for exploratory drilling purposes as illustrated, the structure may be otherwise outfitted and have other applications in arctic waters as an offshore, rigidly positioned platform structure.

The structure 10, as seen in FIG. 2, may be octagonal in shape as desired to provide uniform strength properties and effective resistance to ice floe impacts. Conventional concrete construction techniques may be used to fabricate the substructure consisting of horizontal, top and bottom diaphragms or walls 20 and 21 and peripheral side walls 22 surrounding the top and bottom walls. Also included in the substructure are a plurality of vertical bulkheads 23 which extend between the top and bottom walls 20 and 21 and form a plurality of ballast compartments 24. The substructure may have a lateral dimension on the order of about 345 feet and heaters may be installed in the ballast compartments to prevent freezing of water ballast.

The top wall 20 is located at about mean sea level height, indicated at 26 in FIG. 1, when the substructure 12 is submerged onto the sea floor 27 as illustrated. As will be appreciated, the structure is particularly useful in mean water depths on the order of about 50 feet whereby the top wall accordingly is located at about the 50 ft. structure elevation. Below the top wall, the peripheral side walls 22 extend vertically upwardly from the bottom wall or mat 21 and then slope slightly inwardly at about the 30 ft. structure elevation which normally will be disposed below the depth of anticipated ice floes or sheets even at low water levels. Above the top wall, the side walls continue to slope slightly inwardly to about the 70 ft. structure elevation which normally will be above the high water height. At this level, the side wall again extends vertically upwardly to form wave walls 27 surrounding the superstructure 13. The wave walls 27 are laterally supported against external loads by vertical bulkheads or gussets 28 mounted on an elevated peripheral platform or wall 29 supported atop the top wall 20. The wave walls also terminate at an outwardly curving, annular wave deflector 30 secured to and surrounding the upper end of the superstructure.

Figure 3:
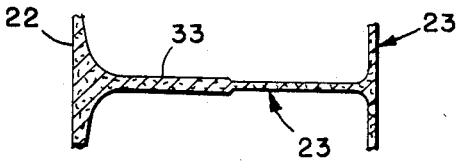
FIG. 3 is an enlarged fragmentary horizontal section through the structure of FIG. 1 taken substantially along the line 3—3 thereof.

As seen in FIGS. 1 and 3, the diametral bulkheads 23 (those extending at right angles to respective side walls 22 of the substructure 12) have relatively thick upper and lower portions 31 and 32 adjacent and tied to the top and bottom walls 20 and 21, respectively. At opposite ends of their collective transverse expanses, such upper and lower portions are each vertically tapered, each portion increasing in vertical dimension going from the center of the substructure to the respective side walls thereof as seen in FIG. 1. Such upper and lower portions, at corresponding ends thereof, also merge together and form vertically expansive and thick portions 33 which are adjacent to and extend at right angles to respective side walls. Such strategic thickening of the bulkheads provides for effective lateral load transfer from the side walls and into the structure with a savings in overall structure weight.

Still referring to FIGS. 1 and 2, the substructure 12 and superstructure 13 together have a large, common through hole 34 which forms a moon pool through which drilling operations are performed. Received within the lower end of the moon pool is a well protector caisson 35 adapted to be embedded in the sea floor foundation or substratum as illustrated. The caisson is designed to contain one or more well heads and associated equipment and may be releasably tied at its upper end to the interior wall of the moon pool 34 as at 35. The securement 35, however, is of a type which will allow the caisson to separate from the moon pool upon the highly unlikely occurrence of excessive sliding of the structure on the sea floor. Accordingly, the caisson extends through an oversized opening in the bottom wall 21 of the substructure 12 to allow for some lateral shifting of the structure. If desired, a plurality of smaller diameter caissons may be provided for respective well heads.

The substructure 12 also is provided with a plurality of vertical spud guides 40 which are interposed between the bulkheads 23 and connected top and bottom to the top and bottom walls 20 and 21, respectively. The spud guides may number more than 40 and extend upwardly and through the peripheral platform 29 with their top ends opening above sea level 26. In FIG. 2, a few of the spud guides arranged about the periphery of the substructure are shown. The spud guides also are sealed to the top and bottom walls to preserve watertightness of the ballast compartments 24 through which they pass.

The spud guides 40 are sized to receive respective spuds 42 which are adapted to be embedded at their lower ends in the sea floor substrate. The spuds preferably are large diameter, thick walled ($1\frac{1}{2}''$ to $4''$) steel cylinders having a yield point of about 50,000 psi and a length exceeding the height of the spud guides by their intended maximum depth of penetration. For example, the spuds may be about 7 feet in diameter and have a length on the order of 110 feet whereas the spud sleeves may have a height of about 65 feet thus allowing for spud penetrations on the order of about 40 feet with about 5 feet of the spud extending above the spud guide. To accommodate anticipated impact loadings from summer ice floes at the low ambient temperatures, relatively ductile steel is employed, such having the carbon content limited to 0.12%, the carbon equivalent to 0.45% and a transverse Charpy impact value of about 15 ft. lbs. at $-5°$ C. The spuds desirably are epoxy coated in the upper portions and cathodically protected by sacrificial anodes in the lower portions. The tip of spuds also may be reinforced by tough steel rings in order to prevent local damage to the tip during installation.

Figure 5:
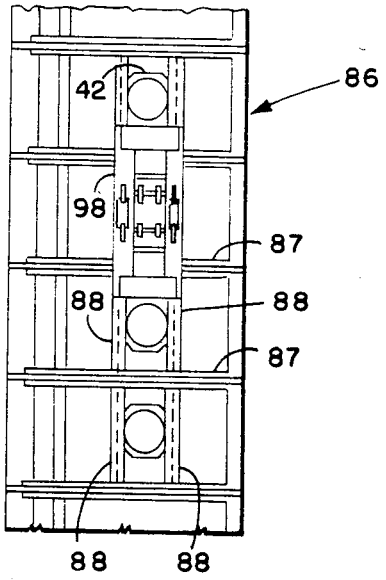
FIG. 5 is a reduced top plan view as seen from the line 5—5 of FIG. 4.
Figure 4:
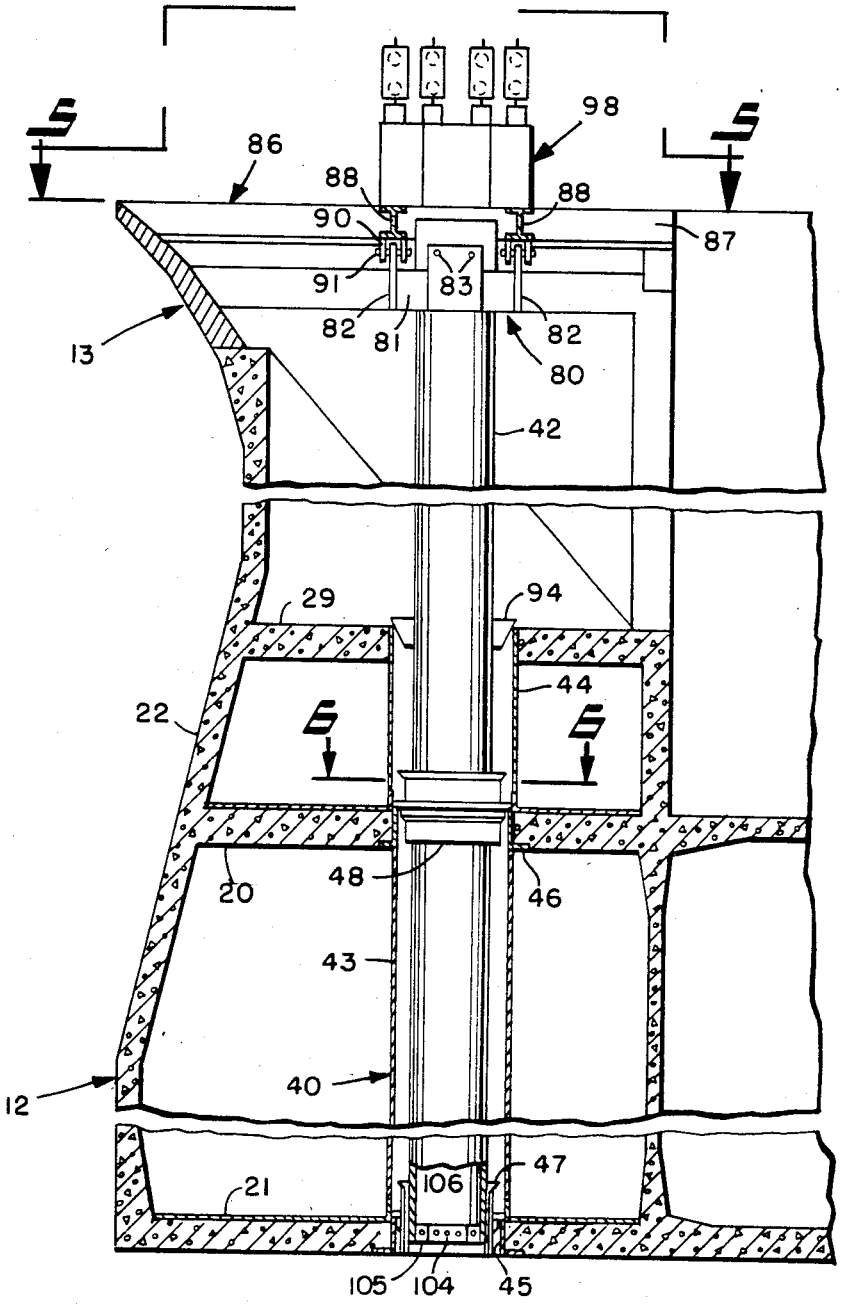
FIG. 4 is an enlarged fragmentary vertical section through the structure showing a spud hung from removable hangers.

Referring now to FIGS. 4 and 5, each spud guide 40 can be seen to include lower and upper steel cylinders or sleeves 43 and 44 which have inner diameters slightly greater than the outer diameter of a spud 42. The lower sleeve 43 is installed between the bottom and top slabs or walls 20 and 21 with its bottom and top ends welded to respective bearing sleeve assemblies 45 and 46 while the upper can 44 is welded to the top bearing sleeve and extends upwardly therefrom to the elevated platform 29. The bottom and top bearing sleeve assemblies 45 and 46 are cast integrally in the bottom and top walls and contain respective bushing assemblies 47 and 48 which provide for lateral load transfer from the spuds to the bottom and top walls at respective fulcrum points. Since the bottom and top assemblies are of similar construction, only the latter will be further described with the understanding that such description is equally applicable to the bottom bushing sleeve and bushing assemblies.

Figure 6:
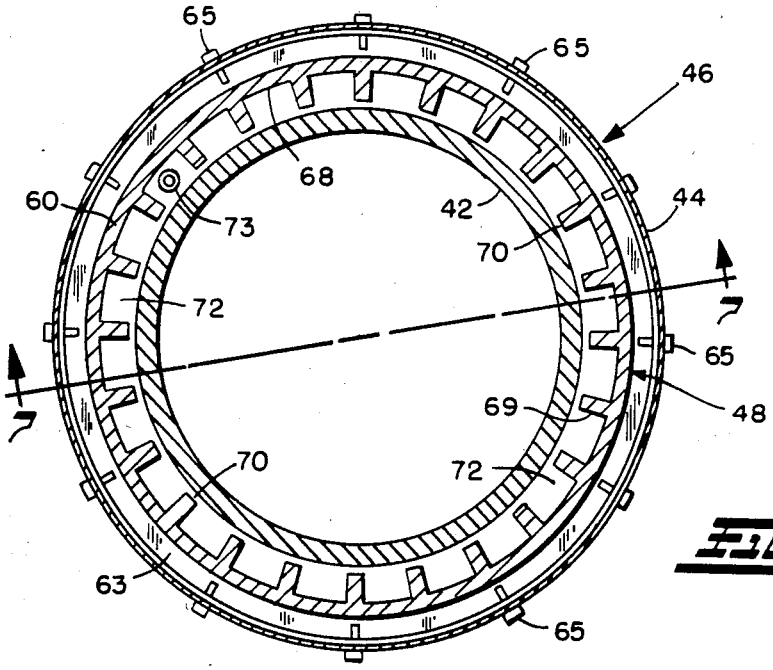
FIG. 6 is an enlarged top plan view of an installed spud bushing as seen from the line 6—6 of FIG. 4.
Figure 7:
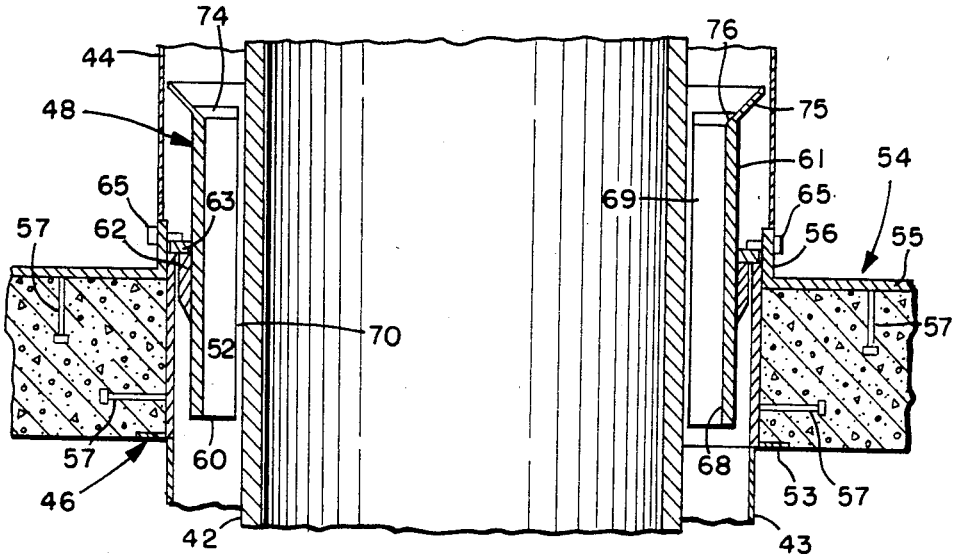
FIG. 7 is a diametral section through the spud bushing of FIG. 6 taken substantially along the line 7—7 thereof.

In FIGS. 6 and 7, the top bushing sleeve assembly 46 can be seen to include a metal bushing sleeve 52 which may be cast integrally in the top wall 21. At its lower end, the bushing sleeve has a radially outwardly extending annular flange 53 which engages the adjacent underside of the top wall. At its upper end, the bushing sleeve projects above the top wall and has a top plate 54 butted against or welded to its outside diameter. Such top plate has a planar portion 55 overlying the top wall and an annular upright portion 56 surrounding the projecting upper end of the bushing sleeve and extending thereabove. As shown, the bushing sleeve and top plate may be anchored in the top wall by anchors 57 and the lower and upper spud guide sleeves 43 and 44 may be welded to the lower end of the bushing sleeve and upper end of the upright portion 56, respectively.

The bushing sleeve 52 is sized to receive and support the bushing assembly 48 which includes a cylindrical steel bushing 60. Secured to the outer cylindrical wall 61 of the bushing about midway along its axial length, as by a ring mount 62, is an annular hanger flange 63 which extends radially outwardly. As seen in FIG. 6, the hanger flange and bushing sleeve are dimensionally related such that the upper end face of the bushing sleeve forms a support shelf for the hanger flange. Also, the bushing has an outer diameter less than the inner diameter of the bushing sleeve, as on the order of 6" to 12", by a little more than twice the radial thickness of the ring mount so that its lower end may be lowered into the bushing sleeve until the hanger flange comes to rest atop the bushing sleeve.

When set in the bushing sleeve 52 as seen in FIGS. 6 and 7, the bushing 60 preferably is held in place by a plurality of circumferentially arranged retaining pins or studs 65. The studs are removably received in respective bores or holes provided in the annular upright portion 56 of the top plate 54. When inserted into such bores as shown, the retaining pins have radially inwardly projecting shanks which overlie the hanger flange 62 and thus restrict vertical upward movement thereof. Preferably, such shanks are spaced from the upper end face of the bushing sleeve a distance slightly greater than the thickness of the hanger flange to allow limited pivotal movement of the bushing within the bushing sleeve.

At its inside wall 68, the bushing 60 is provided with a plurality of axially extending or vertical spacer blocks or ribs 69 which are circumferentially equally spaced apart and which may extend the full axial length of the bushing. The spacer blocks radiate inwardly from the inside wall an equal distance and have axially elongated bearing surfaces which collectively support the axially movable spud 42. As shown, the generally flat bearing surfaces of the spacer blocks form a discontinuous cylindrical bearing surface having a diameter slightly greater than the outer diameter of the spud being guided and laterally supported thereby. Through interaction of the spud with the bushing and the bushing with the bushing sleeve embedded in the top wall 21, high lateral loads may be transferred from spud to structure, and vice versa. Also, the bushing may pivot relative to the bushing sleeve to allow for bending or flexing of the spud as may occur under high loads.

The spacing 72 between the spacer blocks 69 is selected to allow for downward passage of a jet pipe or the like between the spud 42 and the inside wall 68 of the bushing 60. For use with a spud having an 84" outer diameter, the bushing may have a 103.5" outer diameter and 4" by 6" spacer blocks arranged at 15° intervals and a length of about 4'. It also is noted that the bushing sleeve 52 may have a 112" inside diameter and a length of about 2' corresponding to the thickness of the top wall 21. To facilitate insertion of a jet pipe, one being shown at 73, the top edges of the spacer blocks preferably are beveled as seen at 74 to guide such pipe into a spacing 72. Also provided is an annular deflector plate 75 which is fixed to the top outer edge of the bushing. As seen in FIG. 6, the deflector plate extends radially outwardly and upwardly from the bushing to span the annular gap between the bushing and adjacent spud guide sleeve 44 and thereby prevent inadvertent passage of jet pipe or the like therebetween. The deflector plate also forms a continuation of the beveled top edge 76 of the inside wall 68 whereby the jet pipe will be guided into and through one of the axial spacings 72.

Referring again to FIGS. 4 and 5 each spud 42 may have a head assembly 80 including a horizontal collar 81 fixed thereabout and four quadrant spaced, vertical plates 82 fixed to the outer diameter of the collar to form two sets of opposed parallel plates. Each plate 82 projects above the collar and is provided with two horizontally aligned through holes 83 at its upper corners.

As shown, each spud 42 can be hung by its head 80 from the upper peripheral framework 86 of the superstructure. The framework 86 includes an array of horizontal and parallel, wide flange beams 87 which are located above and on opposite sides of respective pairs of spuds as best seen in FIG. 5. The beams 87 are adapted to support thereon a pair of removable transverse beams or bars 88 associated with a respective spud. As seen in FIG. 5, the beams 87 and transverse bars 88 form a rectangular opening through which the top end of a respective spud may extend.

The spacing of each pair of transverse bars 88 is set to match the spacing between opposed spud head plates 82 which may be aligned therewith by rotation of the spud 42 as needed. Each transverse bar has a pair of depending parallel flanges 90 which receive the projecting upper end of a respective one of the opposed head plates for clevis connection by pins 91. Two pins may be provided for each head plate, the pins extending through the holes 83 and corresponding holes in each flange 90 of the respective transverse bars 88.

The transverse bars 88 accordingly form a removable hanger for fixedly yet releasably securing the spuds 42 in an elevated position within the spud guides 40 when not in use such as during transport of the structure 10 to an installation site. The spuds additionally may be carried in their spud guides by wedges 94 inserted between the open top ends of the spud guides and the sides of the spuds. The wedges desirably are employed to hold or prevent the spuds from swinging in the spud sleeves which are slightly oversized.

Reverting briefly to FIGS. 1 and 2, the structure 10 further can be seen to be equipped with two diametrically opposed cranes 96. Together the cranes can sweep all of the spud guides 40 for purposes of spud placement and manipulation in the manner hereinafter described. The cranes also serve as transfers for a spud driver seen at 97 in FIG. 1 and spud extractor seen at 98 in FIGS. 4 and 5. The spud driver may be a vibratory or impact pile driver adapted to engage the top of a spud for driving purposes whereas the spud extractor may be a chain or rope cable jack on a vibratory extractor. As will be appreciated, the driver and extractor may be transferred by the cranes from one spud to another for selective driving and extraction of the spuds. In addition, the spuds may be extracted by capping the spud with a steel dome and then introducing water pressure to force the spud out. Preferably, equipment for all spud extraction techniques is provided to accommodate different soils that may be encountered. Also, the spud driver may be and preferably is augmented with water jets as in the manner described herein.

Deployment of the Structure

Once constructed, the structure 10 can be floated to a desired arctic offshore installation site, as by towing or pushing with tugs, during a period of the year when the involved arctic waters are free or relatively free of ice. The structure may be towed fully equipped or, as needed to meet draft requirements along its journey, various items such as consumables may be taken separately on barges. The spud sleeves 40 also may be capped top or bottom, or both, and then evacuated of water to provide additional buoyancy to the structure. If any site preparation is required to present a level sea floor on which the structure will rest, such preferably is performed prior to arrival of the structure to minimize installation time. It also may be necessary to build up a berm or dredge a shallow pocket for the structure depending on the encountered depth of water so that the structure, when ballasted onto the sea floor, will sit at a desired operating depth.

Figure 8:
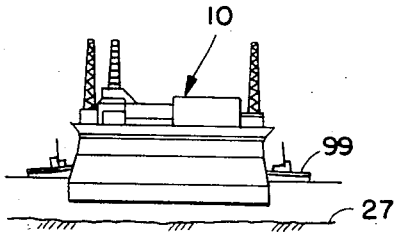
FIG. 8–11 are sequential schematic illustrations showing various stages of structure deployment.

Once the structure 10 is at the installation site as seen in FIG. 8, water can be admitted into the ballast compartments 24 in the substructure 12 to ballast or weight the structure down onto the sea floor 27 while the structure is held in place by tugs 99 or other suitable means. The manner in which ballast is introduced into the substructure can be controlled by appropriate means on the structure to maintain desired trim of the structure while it is being lowered onto the sea floor. Underbase jetting and if necessary modest underbase filling may be performed to assure good contact with the sea floor. When the loading of the structure is sufficient to hold the structure in place against wave action and currents by reason of friction between the bottom of the substructure and sea floor, spud insertion may commence during final ballasting of the structure. As is desirable, several spuds, within a very short period after setting of the structure on the sea floor, are dropped to settle in the soils to ensure against lateral displacement during the spud insertion procedure.

The spud insertion procedure first involves determination of the number, location and penetration of spuds required to provide adequate lateral displacement resistance against anticipated ice loads given the foundation soil formations peculiar to the installation site. The soils close to deltas and in protected areas off the northern coasts of Alaska and Canada in which recent deltaic sediments can or have accumulated may consist of sands overlaid with up to 20 feet of clay materials which typically are considerably weaker in shear strength relative to the underlying sands. An illustration of this type of sea floor foundation can be seen in FIG. 12 with the weak or low shear soil layer indicated at 100 and the strong or high shear soil layer indicated at 101. It also is noted that weak sediments are not only found at the sea floor or mud line 27 but at depth as illustrated in FIG. 13. Weak layers on the order of 2′ to 12′ thick have been found at depths of 12′ to 20′ below the mudline. The difference in shear strengths between the weak and strong layers may be quite dramatic at the interfaces of such layers.

At this stage of the installation, equipment on board the structure may be utilized to determine the soil conditions and formations at the site. Based upon this analysis, a determination of the required number, location and penetration of spuds can be made such as from pre-engineered operations strategies. As will be appreciated, the number, locations and penetrations of spuds may be varied to achieve desired balance and lateral displacement resistance to ice loads within a very large range. On the other hand, only the required number of spuds need be installed to the required depth thus reducing installation time as well as the number of spuds that later will be extracted upon redeployment of the structure. Also, ballasting of the structure can be adjusted or tuned to optimize the bearing values and shear mechanisms to the installation site.

Figure 9:
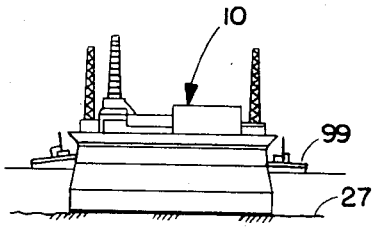

Since the spuds 42 will be hanging in their spud guides 40 as previously indicated, an appropriate one of the cranes 96 may be utilized to pick each spud up so that the pins 91 and wedges 94 can be removed. Once a spud is free of the pins and wedges, the transverse hanger bars 88 can be removed and the spud let down to settle into the soil under its own weight as seen in FIG. 9. Soil penetration into clay material may be on the order of about 10 feet.

Figure 10:
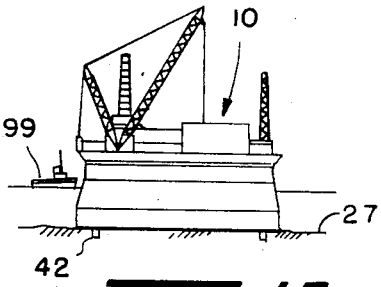

At this point, the spud driver 97, preferably a vibratory hammer, may be positioned atop each selected spud 42 to drive it to required depth as seen in FIG. 10. In some soils it may be preferable to use an impact hammer, in which case a hard wood timber driving head is used between the driver and spud to minimize noise transfer to surrounding waters for environmental reasons. As previously indicated, the illustrated spuds are adapted to be driven approximately 40 feet into the sea floor foundation. Jetting may be used as desired to assist in driving the spuds, a ring of jets 104 being built into each spud at the tip thereof. Such jets are manifolded as seen at 105 in FIG. 4 and connected by a riser 106 extending upwardly through the interior of the spud to associated pumping equipment aboard the structure.

The jetting is employed to keep the core or plug of soil inside the pile liquefied so that it doesn't act like a solid tip impeding penetration. Also, the jetting serves hydraulically to break up, along with the mechanical action of the vibratory hammer, overconsolidated soils in the path of the spud to facilitate penetration. Penetration such as through clay layers also may be facilitated by or require drilling of one or more small diameter holes in and ahead of the plug to allow the subsequent action of the vibratory hammer and ring jets to break down dense soil structure. To drill these holes, a high pressure cutting jet may be employed to drill, for example, 8″ diameter holes in deep overconsolidated silt. In the case of extremely dense or frozen soils, a rotary drill operable from the crane boom can be employed.

During driving, the annulus between the spud 42 and sleeves 43 and 44 may be emptied of water. Sealing at the top can be accomplished by neoprene gaskets and compressed air used to keep the annulus essentially free of water. Alternatively, compressed air may be bubbled up through the annulus to form an air curtain. The purpose of the foregoing is to minimize the sound transmission to the water.

As noted above, the spud guides 40 include steel sleeves 43 and 44 which are installed between the bottom and top slabs or walls 20 and 21 with the sleeves welded to bushing sleeves 45 and 46 which may be cast integrally into the bottom and top slabs. The bushing sleeves contain respective bushings 47 and 48 which provide for lateral load transfer from the spuds to the bottom and top slabs at respective top and bottom fulcrum points, respectively. As will be appreciated, the spuds are free to flex between the top and bottom bushings within the oversized spud guide sleeves. When in use, the spuds also are vertically movable with relatively little vertical resistance within such bushings so that the structure can maintain contact with the sea floor during consolidation settlements and tilt slightly as necessary to develop bearing resistance to overturning moments without overloading the structure locally at spud supports points or fulcrums.

Figure 12:
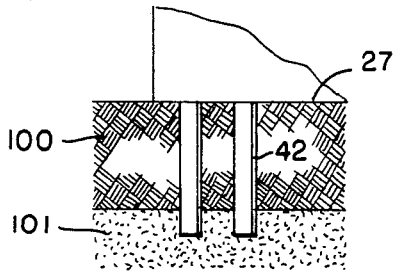
FIGS. 12 and 13 are schematic illustrations showing spuds embedded in different sea floor foundation formations.
Figure 13:
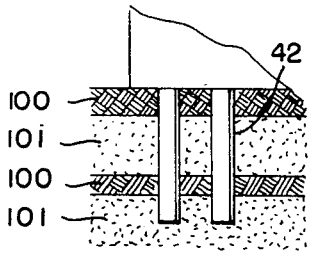
Figure 14:
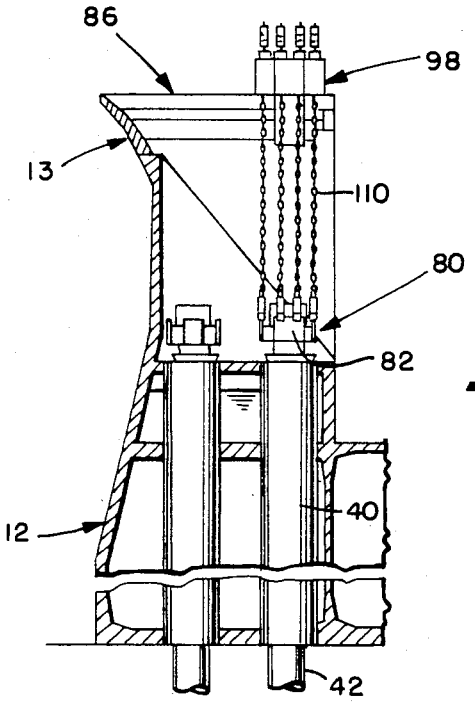
FIG. 14 is an enlarged fragmentary vertical section through the structure showing a modified arrangement employing side-by-side spuds, such spuds being shown deployed with one readied for extraction.

As seen in FIG. 12, the spuds 42 are driven through the relatively weak or low shear soils 100 and into the underlying strong or high shear soils 101 whereby the respective shear capacities of both soil layers combine with the frictional capacity of the substructure/sea floor interface to provide high displacement resistance to lateral ice loads. If the soils are found to correspond to the formation illustrated in FIG. 12, then the piles desirably are driven through both the weak soil layers 100 and the upper strong soil layer 101 for embedment in the lowermost strong soil layer 101. Spud penetrations into the lowermost strong soils generally may be on the order of about 10 feet. After the structure has been fully ballasted and the necessary spuds driven as seen in FIG. 10, platform operation may commence. It also is desirable to install scour protection material about the base of the structure as best seen at 108 in FIG. 1.

Under design ice loads, the structure can displace laterally up to 6" or even 12", depending on encountered soils. The spuds will deflect in a typical P/y curve and develop passive resistance of the soil which further is consolidated by the weight of the structure thereabove. Under overload conditions, the spuds are capable of failure, first in sliding and then in bending, in view of their relatively high length to diameter ratio, prior to damage of the structure. The spuds will plow through the surrounding soils, except in the rare case in which they are founded in fully-bonded permafrost. To enable or preserve this failure mode, any penetration of the spuds into permafrost is limited to that necessary for adequate augmentation of structure base shear capacity.

Once fully installed, the annulus between each spud 42 and respective spud guide sleeves 43 and 44 may be filled with lose or granular fill material such as sand, pea gravel or steel shot to provide additional means of load transfer between spud and structure while allowing bending or bowing of the spud between the top and bottom fulcrum points. Desirable results may also be obtained by using such fill in the absence of the top and bottom bushings. For semi-permanent installations, grout may be used in place of the fill. Moreover, reasonably acceptable performance may be obtained without any fill or bushings by bearing of the spuds on the sleeves.

Deployment of the Structure to Another Drilling Site

Figure 11:
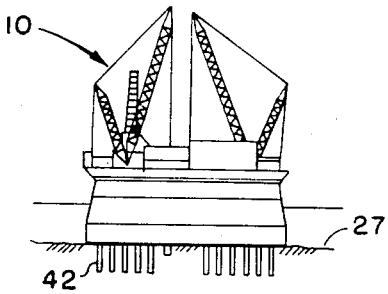

After drilling operations have been completed, the structure 10 may be redeployed to another drilling site. To prepare the structure for take-off, the spuds 42 are extracted from the soils 100, 101 by the use of the chain or rope jack 98. As illustrated in FIG. 11, the chain jack 98 may be positioned atop the superstructure framework 86 above the spud to be extracted and the chains 110 thereof lowered for convenient pin connection to the head ring plates 82 of the spud. The spud may then be jacked out of the soil and lifted to clear the bottom of the structure. As will be appreciated, the framework 86 supporting the jack is rigidly supported atop the substructure 12 for direct transfer of reactionary extraction loads through the substructure to the sea floor. Desirably, a vibrator is employed with the direct lift to facilitate release of the spud from surrounding soils. In FIG. 11, an alternative arrangement of spuds and spud guides is shown, the spuds and guides being arranged in pairs aligned at right angles to an adjacent side wall of the substructure.

Prior to lifting of each spud, the plug therein, if any, preferably is jetted and air lifted out, thus leaving the spud full of water from bottom to top. In the event that the spud has been refrozen in, the column of water may be heated by steam jets to thaw the peripheral ice. It also is noted that a properly gasketed steel domed cap can be attached to the top of each spud by flanged and bolted connections, and water pressure applied therein to obtain considerable jacking force.

After a spud has been lifted clear of the sea floor, the wedges 94 may be inserted around the spud temporarily to hold the spud. The jack 98 is then moved to another spud by the crane 96 to repeat the sequence with another spud. While the other spud is being extracted, the crane may return to pick the previously extracted spud up so that the wedges may be removed and the spud lifted for pin connection of the spud head 80 to the transverse bars 88 which by then have been repositioned on the superstructure framework 86. Wedges then again may be reinserted as indicated to prevent sway or swinging of the spuds within the spud guides 40. The foregoing process is repeated until all embedded spuds have been extracted. Extraction of the spuds may be facilitated by jetting as desired.

During take-off of the structure, bottom suction and any adhesion may be broken by selective ballasting of the substructure. In addition, the spuds and spud guides can be overfilled with water to provide underflooding of the structure base to break such suction or adhesion. With the spuds extracted and secured, the substructure 12 can be deballasted to again float the structure 10. Once floating, the structure can be towed to a new drilling site whereupon the previously described deployment procedure may be repeated to install and laterally fix the structure at such new installation site.

If the structure had suffered an ice load far in excess of design value with the result that substantial sweep had been induced in the spuds thus binding them in the bushings at the base of the structure, the bushings can be jacked free to allow several additional inches of clearance. In the highly unlikely event that a spud 42 could not be extracted such as in the case of severe bending, crimping, etc., a diver can descend inside the protected and heated spud to cut the spud off below the mud line to free it for retraction into the structure. It also is noted that two-piece spuds may be provided so that the bottom piece embedded in the sea floor foundation can be left in place with the top piece being removed for subsequent usage with another bottom piece at the new installation site. Of course, both pieces may be extracted if soil conditions permit thus salvaging the bottom piece for reuse.

Although the invention has been shown and described with respect to a preferred embodiment, it is obvious that equivalent alterations and modifications will occur to others skilled in the art upon the reading and understanding of the specification. The present invention includes all such equivalent alterations and modifications, and is limited only by the scope of the following claims.

The embodiments of the invention in which an exclusive property or privilege is claimed are defined as follows:

1. A mobile offshore platform structure for use in arctic waters wherein the dominant environmental loading threats are posed by winter ice pressures and summer ice floe impacts, said structure comprising an ice load bearing, submergible substructure and a deck receiving superstructure supported on said substructure and above sea level when said substructure is submerged onto the sea floor, said substructure including horizontal top and bottom walls, peripheral side walls surrounding said top and bottom walls, and a plurality of vertical bulkheads extending between said top and bottom walls to form a plurality of base compartments, a plurality of vertical spud guides interposed between said vertical bulkheads about the perimeter of said substructure, and a plurality of spuds extending vertically through said spud guides, said spuds operably being vertically movable in respective spud guides for penetration into the sea floor substrate and laterally restrained by said spud guides in said top and bottom walls for transmission of lateral loads therebetween at respective fulcrum points vertically spaced apart to permit flexing of said spuds therebetween.

2. A structure as set forth in claim 1 wherein said substructure has a height approximately equal the depth of submergence.

3. A structure as set forth in claim 2 wherein said side walls extend above said top wall to form wave walls surrounding said superstructure.

4. A structure as set forth in claim 3, further comprising vertical bulkheads mounted atop said substructure for supporting said wave walls against lateral loads.

5. A structure as set forth in claim 1 wherein said spud guides include top and bottom bushings laterally supporting respective spuds while permitting relative vertical movement between said spuds and substructure, said top and bottom bushings being located at said top and bottom walls, respectively.

6. A structure as set forth in claim 5 wherein said top and bottom bushings each are cylindrical and have a plurality of spacer blocks circumferentially spaced around its inside wall, said spacer blocks having radially inner, vertically elongated surfaces which are circularly arranged and in bearing engagement with the respective spud.

7. A structure as set forth in claim 6 wherein spaces between adjacent spacer blocks allow for vertical passage of jet pipes or the like between the spud and inside wall of the bushing.

8. A structure as set forth in claim 7 wherein the top edges of said spacer blocks are beveled for guided passage of a jet pipe or the like into said spaces.

9. A structure as set forth in claim 5 wherein each bushing includes means for allowing vertical passage of a jet pipe therethrough.

10. A structure as set forth in claim 5 further comprising means for mounting said top and bottom bushings in said top and bottom walls, respectively, while permitting limited pivotal movement of said bushings relative to respective walls.

11. A structure as set forth in claim 5 wherein said top and bottom bushings are supported for limited pivotal movement on bushing sleeves embedded in respective top and bottom walls.

12. A structure as set forth in claim 11, wherein said bushings are retained in respective sleeves by removable pins.

13. A structure as set forth in claim 1 wherein said spud guides include spud sleeves connected top and bottom to said top and bottom walls.

14. A structure as set forth in claim 13 wherein said spud sleeves are sealed to said top and bottom walls.

15. A structure as set forth in claim 13 wherein said spud sleeves and respective spuds define an annular gap therebetween, and said annular gap is filled with loose fill material to provide for additional lateral load transfer between the spuds and substructure while allowing bending of the spuds between the vertically spaced fulcrum points.

16. A structure as set forth in claim 1 wherein said bulkheads have relatively thick upper and lower portions adjacent and tied to said top and bottom walls, said upper and lower portions being vertically tapered and merging together to form vertically expansive and thick end portions which are adjacent to and extend at right angles to respective side walls of said substructure.

17. A structure as set forth in claim 1 further comprising means for fixedly but releasably securing said spuds in an elevated position within said spud guides.

18. A structure as set forth in claim 17 wherein each spud has a head, and said means for fixedly but releasably securing includes a respective hanger supported on said superstructure above each spud and means for pin connecting the head of the spud to the hanger.

19. A structure as set forth in claim 18 wherein said head includes an annular collar and at least two vertical plates secured to the outer diameter of said collar in diametrical opposition, and said hanger includes a pair of transverse beams each having depending flanges for receipt and pin connection to a respective one of said plates.

20. A structure as set forth in claim 18 wherein said hanger is removable to obtain clear vertical access to the top of said spud.

21. A structure as set forth in claim 18 wherein said means for fixedly but releasably securing further includes a plurality of wedges adapted to be wedged between outer sides of said spuds and inner sides of said spud guides.

22. A structure as set forth in claim 21, further comprising means for elevating said spuds relative to said spud guides to permit insertion and removal of said wedges.

23. A structure as set forth in claim 1, further comprising spud driving means, and transfer means on said superstructure for moving said spud driving means from one spud to another for selective driving of a multiple number of said spuds from said superstructure.

24. A structure as set forth in claim 1, further comprising spud extracting means, and transfer means on said superstructure for transferring said spud extracting means from one spud to another for selective extraction of a multiple number of said spuds from said superstructure.

25. A structure as set forth in claim 1 wherein the length of said spuds exceeds the height of said spud guides by an amount equal their maximum extent of penetration.

26. A structure as set forth in claim 1 wherein each spud is a hollow, thick-walled steel cylinder.

27. A structure as set forth in claim 1 wherein each spud guide includes a hollow steel cylinder adapted to receive therein a respective cylindrical spud.

28. A structure as set forth in claim 1 wherein said spud guides have a length greater than the submergible depth of said substructure whereby the tops of said spud guides will extend above sea level when said substructure is submerged onto the sea floor.

29. A structure as set forth in claim 1 wherein said substructure has a moon pool for accommodating a plurality of well heads, and further comprising a caisson for protecting the well heads upon embedment in the sea floor substrate, said caisson when embedded extending into said moon pool but allowing for relative lateral movement of said substructure.

30. A structure as set forth in claim 1 wherein each spud is formed from a retractable top piece and a detachable bottom piece.

31. A structure as set forth in claim 1 wherein said spuds have a high length to diameter ratio whereby they will yield to large lateral loads by bending to prevent high localized stresses in the substructure.

32. A structure as set forth in claim 1 wherein said spud guides and respective spuds define an annular gap therebetween, and said annular gap is filled with loose fill material to provide for lateral load transfer between the spuds and substructure while allowing bending of the spuds within said spud guides.

33. An arctic offshore platform installation capable of resisting large ice loads, comprising a platform superstructure supported on a ballasted substructure resting on the sea floor for vertical load transfer to the sea floor and also lateral load transfer through friction between the bottom of the substructure and the sea floor, said superstructure and substructure having a vertical through hole defining a moon pool, a well head protecting caisson received at its top end within said moon pool and embedded at its lower end in the sea floor substrate, said caisson being arranged and sized to allow for relative lateral and vertical shifting of the substructure due to vertical and lateral loads thereon, and a plurality of extractable spuds laterally restrained at their upper ends in said substructure and embedded at their lower ends in the sea floor substrate for transfer of lateral loads acting on the substructure to the sea floor substrate.

34. An installation as set forth in claim 33 wherein said substructure has a height approximately equal its depth of submergence.

35. An installation as set forth in claim 33 wherein said substructure has peripheral side walls extending thereabove to form wave walls surrounding said superstructure.

36. An installation as set forth in claim 33, further comprising means supported atop said substructure for extracting said spuds from the sea floor substrate to allow for redeployment of the structure at another installation site.

37. An installation as set forth in claim 33 wherein said spuds penetrate into the sea floor substrate a sufficient distance to encounter relatively high shear foundation soils overlaid by relatively low shear foundation soils.

38. An installation as set forth in claim 33 wherein the tops of the embedded spuds extend above sea level.

39. An installation as set forth in claim 33 wherein said spuds are laterally restrained in said substructure at vertically spaced fulcrum points.

40. An installation as set forth in claim 39 wherein said fulcrum points coincide with horizontal load bearing walls in said substructure.

41. An installation as set forth in claim 33 wherein said substructure includes a plurality of spud sleeves for said spuds, said spud sleeves and respective spuds defining an annular gap therebetween, and said annular gap being filled with loose fill material to provide lateral load transfer between the spuds and substructure.

42. An installation as set forth in claim 33 wherein said substructure is selectively ballasted for desired confining of the sea floor substrate beneath said substructure and in which said spuds are embedded.

43. An arctic structure installation capable of resisting large lateral ice loads at an offshore site having a relatively low shear sea floor foundation layer of substantial depth overlying a considerably higher shear foundation layer, said installation comprising a mobile drilling structure including a platform superstructure supported on a substructure ballasted to rest on the sea floor for vertical load transfer and also lateral load transfer through friction between the bottom of the substructure and the sea floor, said substructure including horizontal top and bottom walls, peripheral side walls surrounding said top and bottom walls, and a plurality of vertical bulkheads extending between said top and bottom walls to form a plurality of base compartments, a plurality of vertical spud guides interposed between said vertical bulkheads about the perimeter of said substructure, and a plurality of spuds extending vertically through said spud guides, said spuds operably being vertically movable in respective spud guides for penetration into the sea floor substrate and laterally restrained by said spud guides in said top and bottom walls for transmission of lateral loads therebetween at respective fulcrum points vertically spaced apart to permit flexing of said spuds therebetween, said spuds extending downwardly through said low shear foundation layer and into said higher shear foundation layer whereby the shear capacities of both foundation layers are combined with the frictional capacity of the substructure/sea floor interface to provide high displacement resistance to large lateral ice loads.

44. A mobile offshore platform structure for use in arctic waters wherein the dominant environmental loading threats are posed by winter ice pressures and summer ice floe impacts, said structure comprising an ice load bearing, submergible substructure and a deck receiving superstructure supported on said substructure and above sea level when said substructure is submerged onto the sea floor, said substructure including a plurality of vertical guides about the perimeter of said substructure, and a plurality of bending restraints extending vertically through said guides, said bending restraints operably being vertically movable in respective guides for penetration into the sea floor substrate and cantilevered by said guides in said substructure for transmission of lateral loads therebetween while being sufficiently flexible and ductile to displace under high impact loads for energy absorption and balanced distribution of shear loads into the sea floor substrate.

45. A structure as set forth in claim 44, said substructure operably being selectively ballasted onto the sea floor for desired confining of the sea floor substrate into which said bending restraints operably penetrate.

46. A structure as set forth in claim 1, wherein said substructure and superstructure have approximately equal lateral dimensions.

* * * * *